US005299654A

United States Patent [19]

Duncan

[11] Patent Number: 5,299,654

[45] Date of Patent: Apr. 5, 1994

[54] SAFETY NET SUPPORT SYSTEM

[75] Inventor: Charles W. Duncan, Costa Mesa, Calif.

[73] Assignee: Sinco Incorporated, East Hampton, Conn.

[21] Appl. No.: 843,582

[22] Filed: Feb. 28, 1992

[51] Int. Cl.[5] ..... E04G 21/00

[52] U.S. Cl. ..... 182/138; 182/82

[58] Field of Search ..... 182/137-140, 182/82; 248/293, 292.1

[56] References Cited

U.S. PATENT DOCUMENTS

| | | | |
|---|---|---|---|
| 902,635 | 11/1908 | Wowra | 248/292.1 X |
| 945,762 | 1/1910 | Dieleman | 248/293 |
| 1,347,611 | 7/1920 | Blenko | 248/293 |
| 3,949,834 | 4/1976 | Nusbaum | 182/138 |
| 4,119,176 | 10/1978 | Verdu | 182/138 |
| 4,440,261 | 4/1984 | Clark | 182/82 X |
| 4,838,382 | 6/1989 | Nusbaum | 182/138 |
| 4,856,615 | 8/1989 | Nusbaum | 182/138 X |
| 4,944,365 | 7/1990 | Shalders | 182/82 X |
| 5,083,636 | 1/1992 | Goldenberg | 182/138 |
| 5,161,641 | 11/1992 | Nusbaum | 182/138 |

FOREIGN PATENT DOCUMENTS

| | | | |
|---|---|---|---|
| 71253 | 11/1959 | France | 182/138 |

*Primary Examiner*—Karen J. Chotkowski

*Attorney, Agent, or Firm*—Chilton, Alix & Van Kirk

[57] ABSTRACT

A horizontal safety net support system which is especially adaptable for high-rise building renovation projects employs a collapsable wind brace and a retractable support arm section. The wind brace includes a pair of restraining tubes which are pivotally connected and are maintained in a linear configuration under the force of a spring. A pre-established force applied to the wind brace will result in the wind brace folding to a collapsed position to permit erection of the support arm for cleaning or installation purposes.

22 Claims, 5 Drawing Sheets

SAFETY NET SUPPORT SYSTEM

BACKGROUND OF THE INVENTION

This invention relates generally to safety nets which are employed in conjunction with the construction or renovation of buildings. More particularly, the present invention relates to safety nets which are suspended outwardly from the building in a generally horizontal position and are supported by support arms which are pivotally secured to the building and extend at an angle from below the safety net.

Horizontal perimeter net systems have been used for a number of years during the initial construction of high-rise buildings. The perimeter net systems are installed in response to safety concerns and governmental regulations to protect the public as well as workmen below the net from injury resulting from equipment and other materials falling from the exposed floors of the building. The safety nets are conventionally secured outwardly from the exposed edges of the open floor.

Nusbaum U.S. Pat. No. 3,949,834 discloses a safety net adjustable support for use in conjunction with initial building construction. A safety net is supported outwardly from the edges of the floors of the building and is supported at an inner end by a bracket secured to the upper of two adjacent floors. The net is secured at the outer end to the top of an extension pole. The bottom of the extension pole is supported by an adjustable pole bracket secured to the lower of two adjacent floors. The adjustable pole bracket includes a socket which permits the socket to pivot from a substantially vertical position to an angle for outwardly supporting the net. The pole is ordinarily locked at an outward pivotal position to prevent it from pivoting inwardly during usage of the net. The netting and support poles can be transformed to a vertical position to provide clearance for hoisting materials or for maintenance purposes.

A number of governmental regulations require the use of horizontal nets for certain high-rise construction projects. In addition, there has been a demand for the use of horizontal safety nets in conjunction with renovation projects which are undertaken on existing high-rise buildings. Conventional structures employed to protect the public have primarily been in the form of a rigid sidewalk canopy or scaffold structures wherein provision is made for a covered public walkway.

Conventional canopy/scaffold structures have exhibited several disadvantages including a propensity to restrict access to store front businesses. The conventional structures also present an aesthetically unpleasing appearance and are difficult to clean and free from collected litter. In many instances, the conventional rigid canopy/scaffold structure provides less protection than suspended perimeter net systems with respect to falling objects.

The conventional perimeter net system which is employed for initial construction applications is ordinarily not readily adaptable to the existing building renovation project. For example, in existing buildings the exposed columns or floor slabs, which function as anchoring and support structures for conventional new construction perimeter net systems, are not ordinarily available for the existing building renovation or construction applications. In addition, the support structure and nets must be significantly greater in expanse so as to cover the entire sidewalk. For example, the nets may require a width as great as 25 feet as compared to the standard 15 foot width for conventional perimeter net systems. The increased dimensions of the net also proportionately increase the weight of the net system so that a winch may be required to hoist the nets to the vertical position.

Suspended net systems are subject to significant wind forces and environmental conditions. During high wind conditions, the safety nets present a greater surface area and must be restrained from flapping to prevent equipment from being damaged. Restraining net flapping is also important for aesthetic reasons. However, a very large wind updraft exerted on a suspended net system, which can suddenly occur, is potentially damaging if the system does not provide some resiliency. In addition, the large safety nets must also be pulled in during snowstorms.

SUMMARY OF THE INVENTION

Briefly stated, the invention in a preferred form is a new and improved safety net support system which is especially adaptable to provide sidewalk protection for high-rise building renovation projects.

The safety net support system comprises a number of support units which each have a support arm for the net. The support arm is mounted so that the arm extends at an angle to the vertical and is pivotal relative to the structure to which the safety net system attaches. The arm is braced by a wind brace. The wind brace comprises first and second restraining members. The restraining members are pivotally connected. One of the members connects to the support arm. A spring assembly biases the members in a configuration wherein the members restrain inward pivotal movement of the support arm. The members are pivotally collapsable from the restraining configuration to permit inward pivotal movement of the support arm when an upward force above a pre-established threshold is exerted on the support arm. The wind brace may include a strut and a pair of springs which are disposed between the strut and intermediate spaced locations of the members. The springs, strut and member portions form a generally congruent right triangular configuration. The springs are preferable substantially identical and attached to the members by means of connector tabs, which are equidistantly spaced from the pivot axis. A bracket may be mounted to the support arm and a pivot connection provided between the bracket and the distal end of the wind brace.

In one embodiment, the support arm comprises two sections at the outer tip portion. One of the sections is pivotal between an extended position where the sections are collinear and upwardly extended and a retracted position wherein the one section is downwardly pivoted. A lock pin secures these sections at the extended position. A turn buckle may be employed for adjusting the tension of the springs.

An object of the invention is to provide a new and improved safety net system which may be mounted to existing high-rise buildings in an efficient manner to provide a safety net system of high integrity.

A further object of the invention is to provide a new and improved safety net system which incorporates an efficient structure for accommodating wind conditions.

A yet further object of the invention is to provide a new and improved safety net system for high-rise building renovation projects, which system incorporates improvements for mounting and maintaining the safety net system.

Other objects and advantages of the invention will become apparent from the drawings and the specification.

DETAILED DESCRIPTION OF THE PREFERRED EMBODIMENT

Figure 1:
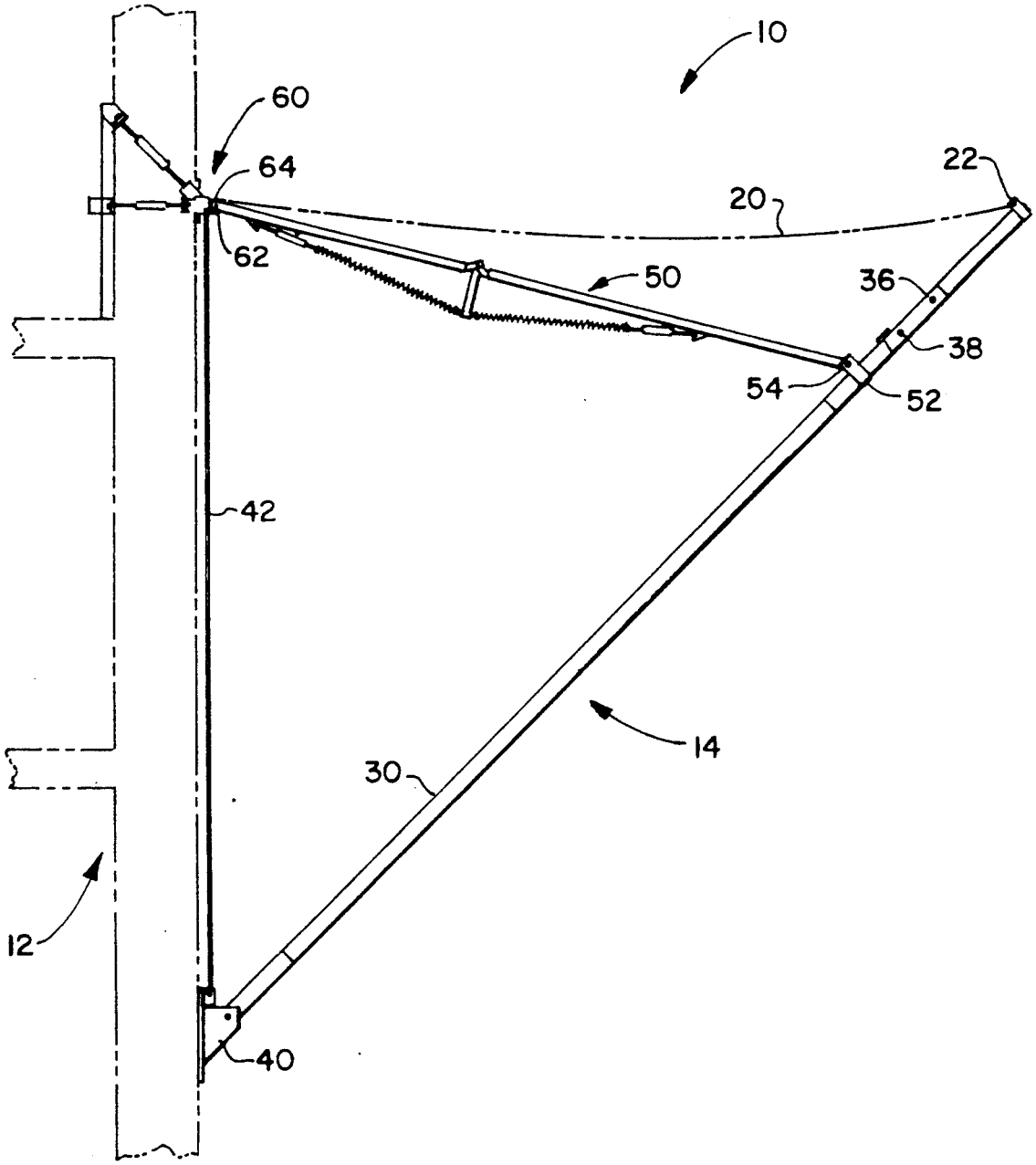
FIG. 1 is a side elevational view, partly in schematic, of an installed safety net system in accordance with the present invention, said system being illustrated in conjunction with a portion of a high-rise building.

With reference to the drawings wherein like numerals represent like parts throughout the figures, a safety net system in accordance with the present invention is generally designated by the numeral 10 in FIG. 1. Safety net system 10 is especially adapted for use in conjunction with renovation project for high-rise buildings schematically represented by the numeral 12. The safety net system 10 includes a safety net 20 which is ordinarily vertically located between the height of the work area and above the sidewalk and is employed to catch falling debris and objects and thereby provide protection to individuals traversing below the safety net.

Figure 2:
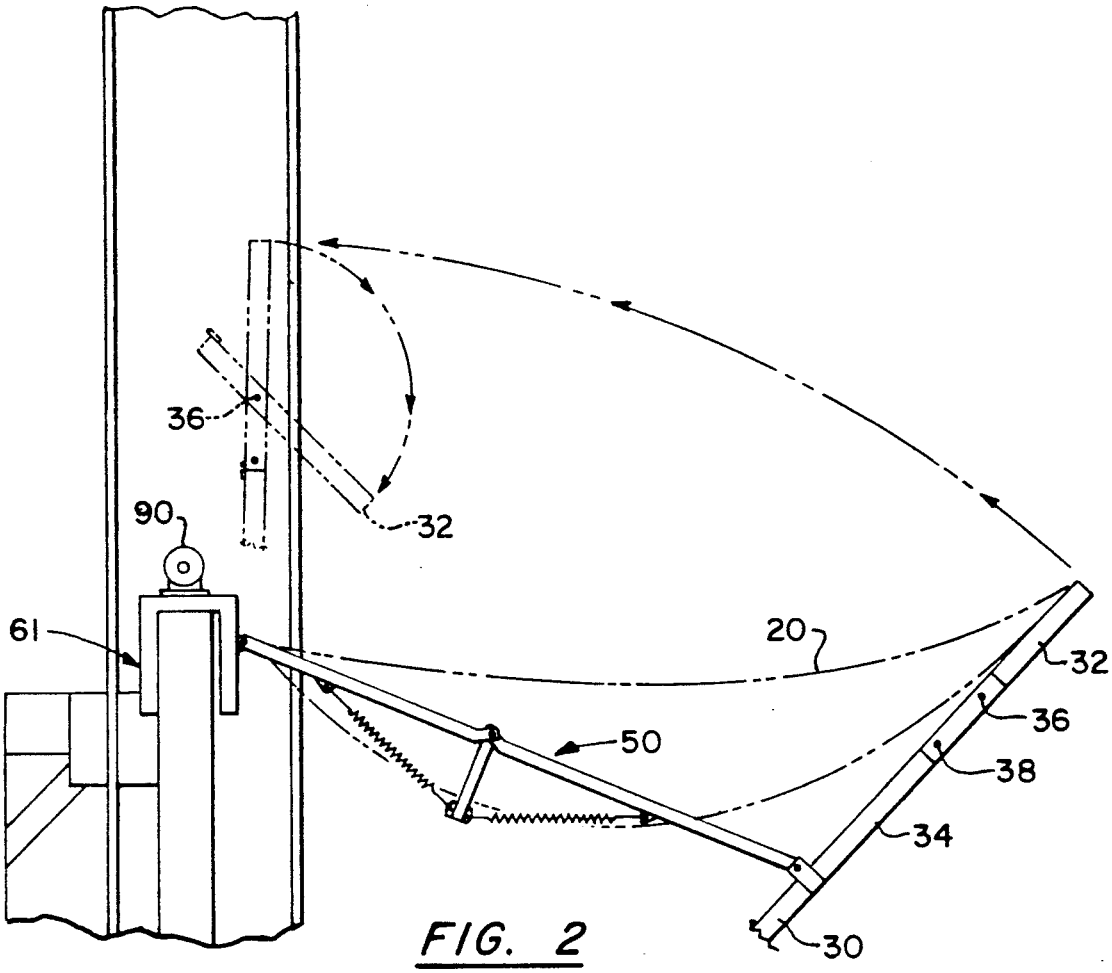
FIG. 2 is a fragmentary side elevational view, partly in schematic, of an upper portion of a second embodiment of an installed safety net system, said system being illustrated in conjunction with a second portion of a high-rise building.
Figure 10:
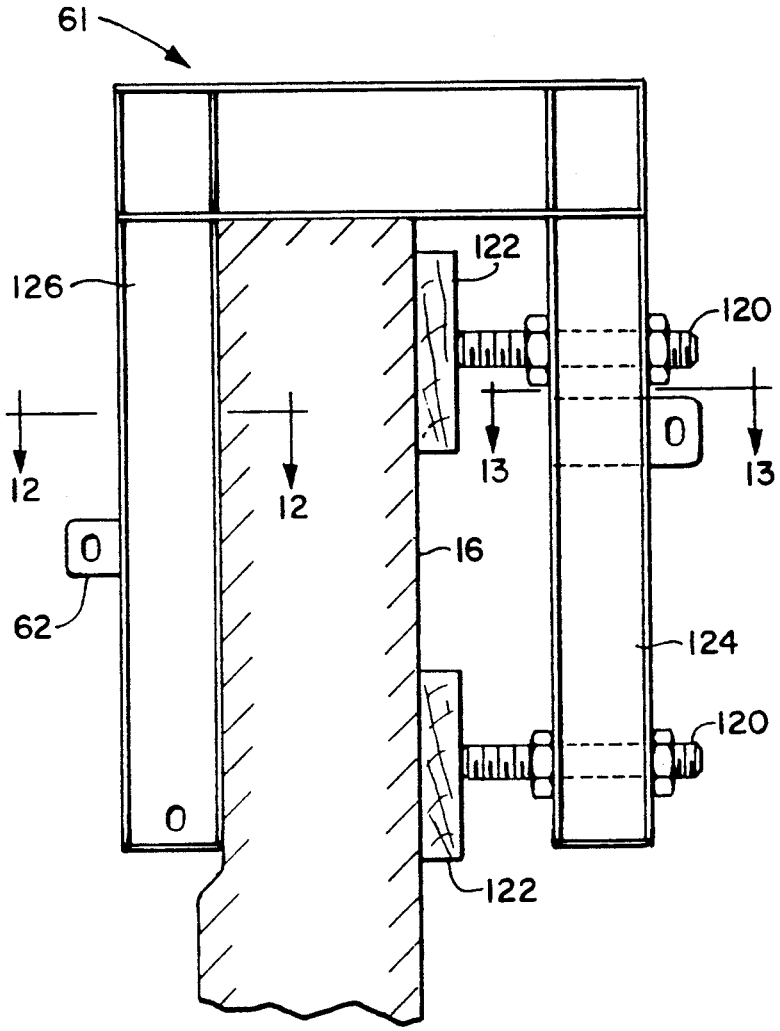
FIG. 10 is a side elevational view, partly in phantom and partly broken away, of a mounting unit which may be employed for the safety net systems of FIGS. 1 and 2, said unit being illustrated as installed on a building parapet.
Figure 11:
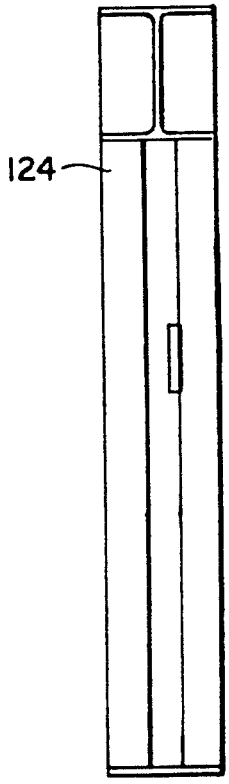
FIG. 11 is a rear view, partly in phantom and portions removed, of the mounting unit of FIG. 10 viewed from the right thereof.
Figure 12:
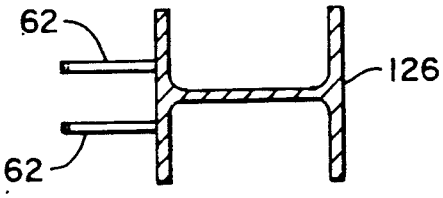
FIG. 12 is a sectional view of the mounting unit of FIG. 10 taken along the line 12—12 thereof.
Figure 13:
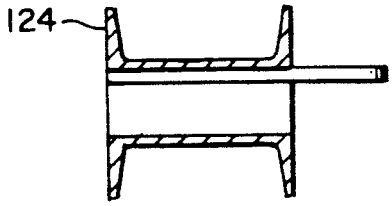
FIG. 13 is a sectional view of the mounting unit of FIG. 10 taken along the line of 13—13 thereof.

The safety net 20 is comprised of one or more net panels. The net is preferably 25 feet wide and is deployed in a general horizontal orientation. The safety net 20 is supported by a a plurality of transversely spaced support units 14 (only one illustrated) which extend outwardly from the building 12. Each support unit comprises a support arm 30 which is mounted to a lower pivoted socket assembly 40. A collapsible wind brace assembly 50 connects between the outer portion of the support arm 30 and is inwardly anchored to a universal mounting unit 60 (FIG. 1) or a parapet clamp unit 61 (FIGS. 2 and 10). The universal mounting 60 is adapted for mounting between windows or columns of the high-rise building. The parapet clamp unit 61 mounts to a building parapet or on the window sill. The support arm socket 40 is supported by a vertical cable 42, suspended from the universal mounting unit 60 or the clamp unit 61. The support arm socket 40 may also be secured to an adjacent column or other anchoring structures.

The safety net 20 is outwardly attached to the support arm 30 by a pin shackle 22 and is also supported and attached by pin shackles to a perimeter cable (not illustrated) which extends between the support arms. An inner cable (not illustrated) extends between the universal mounting unit 60 or or parapet clamp unit 61. Pin shackles also connect the inward edge of the safety net to the inner cable and/or the anchoring units 60 or 61.

Figure 3:
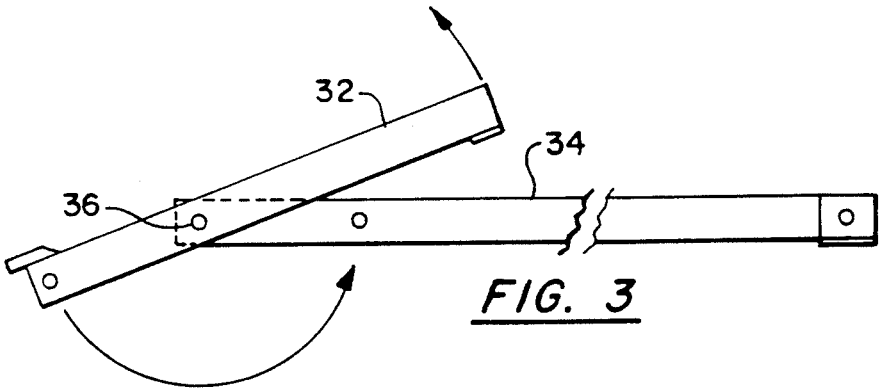
FIG. 3 is an enlarged fragmentary side view, partly broken and partly in schematic, of an upper outer portion of the safety net systems of FIGS. 1 and 2, said system portion illustrated in a pivoted state and viewed from the opposite side of FIGS. 1 and 2.
Figure 4:
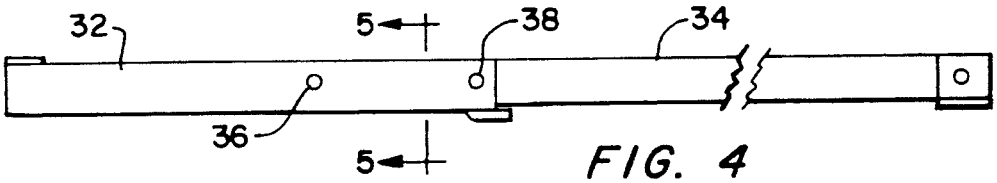
FIG. 4 is an enlarged fragmentary side view, partly broken away, of the safety net portion of FIG. 3, said system portion being illustrated in the non-pivoted state.
Figure 5:
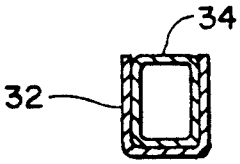
FIG. 5 is a sectional view of the safety net system portion of FIG. 4 taken along the line 5—5 thereof.

The support arm 30 extends outwardly from the building at approximately a 45° angle. The support arm is a tubular steel member which is pivotally mounted at its lower portion to the suspended support arm socket 40. The arm may extend 25 feet or more. With reference to FIGS. 3 and 4, the upper tip of the support arm has a tubular section 32 which is pivotally connected to the principal support arm 34 by a pivot pin 36. A lock pin 38 extends through aligned openings of the lower end of the tip section 32 and the principal support arm 34 to secure the arm in a linear extended relationship as illustrated in FIGS. 1 and 4. The tip section 32 may be unlocked and pivoted downwardly (in the direction of the FIG. 3 arrows) when the support arm is moved to a vertical position (along the FIG. 2 broken-line path) for attaching the net during installation, for dismounting the net or for maintenance of the net. The retractable tip section is advantageous because of the extremely elongated expanse of the support arm.

Figure 14:
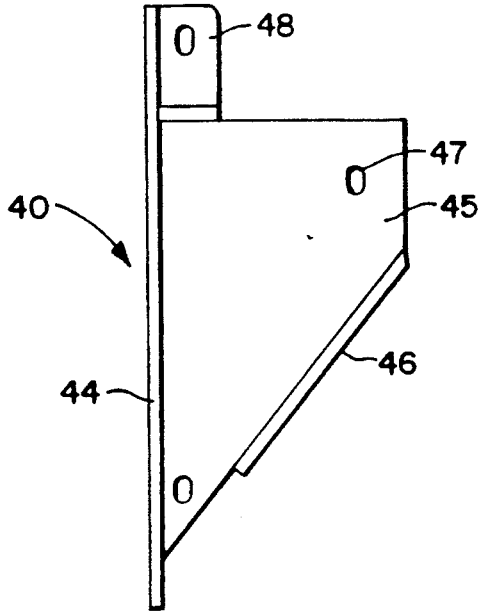
FIG. 14 is a side view of a lower mounting portion of a safety net system of FIG. 1.
Figure 15:
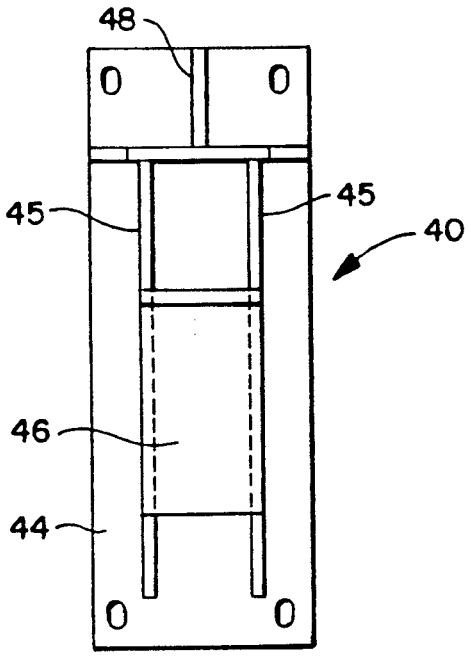
FIG. 15 is a front view, portions removed, of the lower mounting portion of FIG. 14 viewed from the right thereof.

With reference to FIGS. 14 and 15, the support arm socket 40 includes a plate 44 which mounts a pair of parallel trapezoidal shaped plates 45. A support plate 46 extends between the plates 45 to provide an angled socket for the support arm. The plates include an opening 47 which receives a lock pin (not illustrated) for securing the support arms in the angled position. The upper portion of the socket assembly includes a connector 48 which ma connect with the vertical cable 42 for suspending the socket assembly or may be anchored in fixed relationship with the building.

The collapsable wind brace assembly 50 at its outer end is fixedly mounted by a bracket 52 (FIG. 1) to an upper intermediate location of the support arm 30. The bracket 52 receives a pin 54 which provides a pivot connection between the brace and the arm. Likewise, the mounting unit 60 and parapet clamp unit 61 each have a pair of ears 62 (FIG. 1) which receive a pin 64 for pivotally connecting the inner end of the brace.

With additional reference to FIGS. 6–9, the wind brace assembly 50 includes a pair of restraining tubes 66, 68 which in one embodiment are on the order of 6 feet and 8 feet, respectively, in length. The tubes have a slightly angled-ends and are pivotally connected by a pin 70. A strut 72 extends from the pivotal connection. The strut anchors a pair of substantially identical coiled springs 74, 76. The springs may be conventional springs used for overhead garage doors. Tabs 80, 82 are welded to the respective restraining tubes 66, 68 and are generally equidistantly spaced from the axis of the pivot pin 70. The tabs mount a turnbuckle 78 which connects the opposing ends of the springs 74, 76. The turnbuckles 78 can be used to adjust the tension of the springs for a given net system load.

Figure 6:
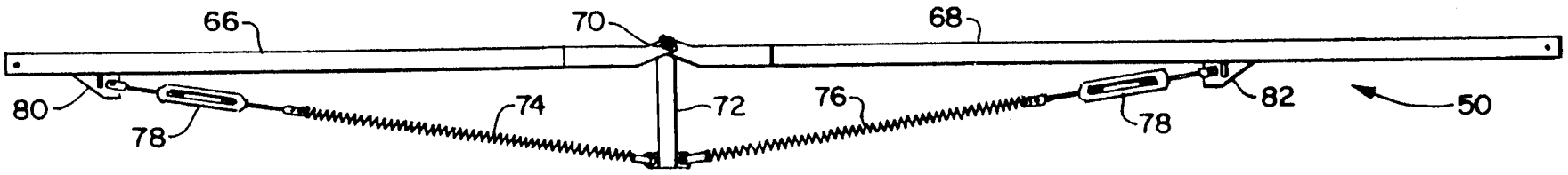
FIG. 6 is an enlarged side view of a wind brace assembly employed in the safety net system of FIG. 1.
Figure 7:
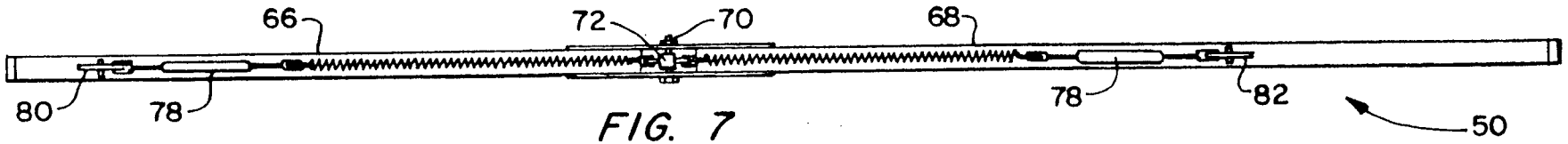
FIG. 7 is a bottom view of the wind brace assembly of FIG. 6.
Figure 8:
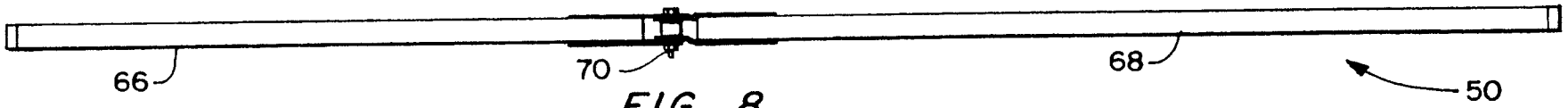
FIG. 8 is a top plan view of the wind brace assembly of FIG. 6.
Figure 9:
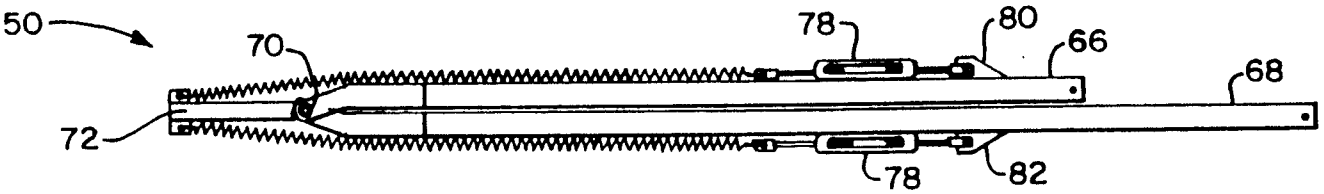
FIG. 9 is a side elevational view of the wind brace assembly of FIG. 6 illustrated in a fully collapsed state.

The springs 74, 76 have a pre-established spring force so that in the normal state, wherein the arms project outward (FIGS. 1 and 2), the brace has a linear configuration such as illustrated in FIGS. 6–8. The brace 50 extends between the universal mounting unit 60 and the support arm 30 to brace the arm and prevent the support arm and net from being pivoted inwardly toward the building during windy conditions. The springs establish a threshold force so that when an upward force exerted on the extended net system exceeds the pre-established force, the wind brace essentially will start to fold and inwardly pivot in the arrow direction of FIG. 1 to allow the support arm to be upwardly pivoted. The extreme collapsed wind brace position of FIG. 9 corresponds to the extreme vertical net position. The wind brace as depicted in FIG. 9 is rotated 90° in relation to the corresponding collapsed FIG. 1 orientation if the wind brace were collapsed. The wind brace is spring biased to return to the extended brace position when the applied force is removed. Consequently, the wind brace while functioning to provide an effective brace during normal work conditions also provides enough system resiliency to automatically allow for the support arm pivoting for extreme wind up-draft conditions as well as for hoisting of the net.

With reference to FIG. 2, it should also be appreciated that because of the extreme load placed on the net support system, a winch 90 ordinarily is required to hoist or erect the net system to the vertical support arm position. The spring pre-load of the wind brace assembly is such that the winch will overcome the pre-established spring force threshold, and the support arm and net can be pivoted to the collapsed brace configuration illustrated in FIG. 9. In addition, at the erected position of the safety net wherein the safety net is essentially against the side of the high-rise building or closely adjacent thereto, the tip section 32 of the support arm may retracted downwardly to facilitate various maintenance activities or to allow for mounting or dismounting of the safety net, as schematically illustrated in FIG. 2.

Figure 16:
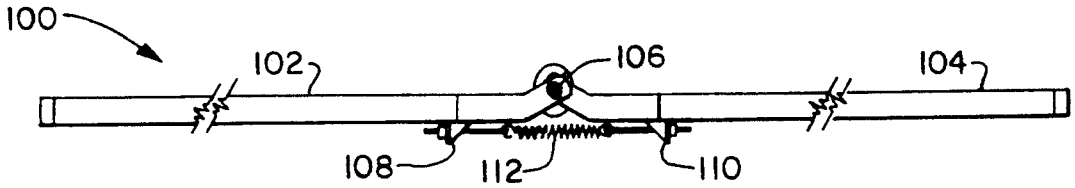
FIG. 16 is a side elevational view, partly broken away, of an alternate embodiment of a wind brace for the safety net system of FIG. 1.
Figure 17:
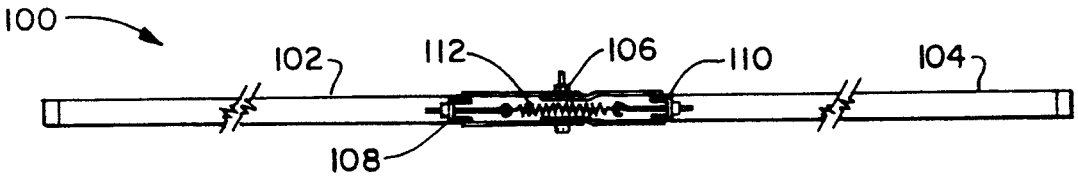
FIG. 17 is a bottom view of the wind brace of FIG. 16.
Figure 18:
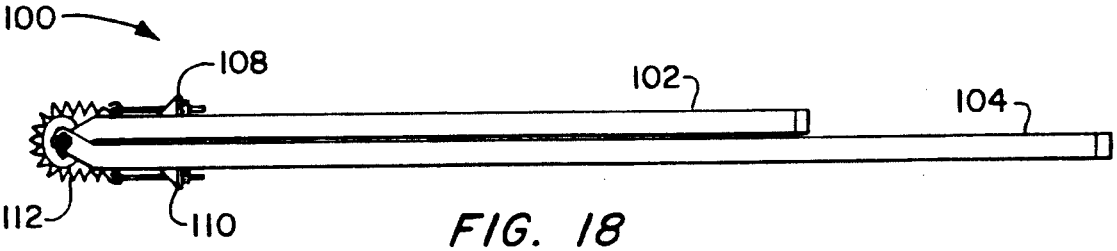
FIG. 18 is a side view of the wind brace of FIG. 16 illustrated in a fully collapsed state.

With reference to FIGS. 16–18 a second embodiment of the wind brace assembly is designated generally by the numeral 100. Wind brace assembly 100 comprises a pair of restraining tubes 102, 104 which are pivotally joined about pin 106. A pair of retaining tabs 108, 110 extend from the underside of the tubes. A double acting spring 112 has a pair of opposed biased ends which are secured by the tabs. The spring 112 biases the restraining tubes to the linear configuration of FIG. 16. The wind brace assembly essentially functions in a manner similar to wind brace assembly 100. When an upward force exceeds the pre-established force of spring 112, the wind brace assembly collapses or folds to permit the erection or pivoting of the support arm and the safety net. The pre-established spring force is selected to correspond to an extreme wind up-draft condition.

With reference to FIGS. 10–13, the parapet clamp unit 61 includes an inverted a U-shaped clamp which fits over the top of the parapet 16 or the window sill. A pair of scaffolding bolts 120 extend from blocks 122 and are threadably tightenable with a fixed frame member 124 for clamping against one side of the parapet 16 or window sill. The outer frame member 126 of the clamp mounts a pair of ears 62 which receive a pin for securing the inward end of the wind brace. The clamp frame members 124, 126 are constructed from a channel-shaped I-beam construction to provide a heavily reinforced anchoring structure.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A support system for a safety net comprising:

support arm means comprising a support arm and mounting means for pivotally supporting said arm at one end and allowing said arm to extend at an angle to the vertical;

brace means comprising first and second sections pivotally joined at ends thereof, said second section connected to said support arm at a distal end, said brace means comprising a strut extending from the joined ends of said sections; and spring means comprising a pair of springs mounted to said brace means and disposed between said strut and intermediate spaced locations of said sections for biasing said sections in a generally linear configuration wherein said sections are pivotally collapsible from said linear configuration when an upward force above a pre-established threshold is exerted on said support arm.

2. The support system of claim 1 wherein said springs, strut and portions of said sections form a generally congruent right triangular configuration.

3. The support system of claim 1 wherein said spring means comprises a pair of substantially identical springs.

4. The support system of claim 1 further comprising connector tabs extending from said sections for attaching said spring means and equidistantly spaced from the pivot axis of said sections.

5. The support system of claim 1 further comprising a bracket mounted to said support arm and pivot connection means for pivotally connecting said distal end of said brace means.

6. The support system of claim 1 further comprising first mounting means for pivotally mounting said first section proximal end to a building.

7. The support system of claim 1 wherein said support arm comprises two sections, one said section being pivotal relative to the other section.

8. The support system of claim 1 further comprising lock pin means for locking said two sections at an extended colinear position.

9. The support system of claim 1 further comprising tension adjustment means for adjusting the tension of said spring means.

10. A support system for a safety net comprising:

support arm means comprising a support arm and mounting means for pivotally supporting said arm at one end and allowing said arm to extend at an angle to the vertical, said support arm means comprising two sections, one section being pivotal between an extended position wherein said sections are colinear and a retracted position wherein said sections are non-colinear;

brace means comprising first and second restraining members and pivot means for pivotally connecting said members, said second member connected to said support arm; and spring means mounted to said brace means for biasing said members in a restraining configuration wherein said members restrain inward pivotal movement of said support arm and said members are pivotally collapsable from said configuration to permit inward pivotal movement of said support arm when an upward force above a pre-established threshold is exerted on said support arm.

11. The support system of claim 2 wherein said brace means further comprises a strut, and said spring means comprises a pair of springs which are disposed between said strut and intermediate spaced locations of said members.

12. The support system of claim 11 wherein said springs, strut and member portions form a generally congruent right triangular configuration.

13. The support system of claim 11 further comprising connector tabs extending from said members for attaching said springs and equidistantly spaced from the pivot means.

14. The support system of claim 2 wherein said spring means comprises a pair of substantially identical springs.

15. The support system of claim 2 further comprising a bracket mounted to said support arm and pivot connection means for pivotally connecting said distal end of said brace means.

16. The support system of claim 2 further comprising lock pin means for locking said sections at the extended position.

17. The support system of claim 2 further comprising tension adjustment means for adjusting the tension of said spring means.

18. The support system of claim 17 wherein said tension means comprises a turnbuckle.

19. A safety net system comprising:

a safety net;

support arm means comprising a support arm for supporting said safety net and mounting means for pivotally supporting said arm at one end and allowing said arm to extend at an angle to the vertical;

brace means comprising first and second sections pivotally joined at ends thereof, said second section connected to said support arm at a distal end; and spring means for biasing said sections in a generally linear configuration wherein said sections are pivotally collapsable from said linear configuration when an upward force above a pre-established threshold is exerted on said support arm.

20. The safety net system of claim 19 wherein said brace means further comprises a strut extending from the joined ends of said sections, and said spring means comprises a pair of springs which are disposed between said strut and spaced locations of said sections.

21. The safety net system of claim 19 further comprising first mounting means for pivotally mounting said first section proximal end to a building.

22. The safety net system of claim 19 further comprising tension adjustment means for adjusting the tension of said spring means.

* * * * *

UNITED STATES PATENT AND TRADEMARK OFFICE

CERTIFICATE OF CORRECTION

PATENT NO. : 5,299,654
DATED : April 5, 1994
INVENTOR(S) : Charles W. Duncan

It is certified that error appears in the above-indentified patent and that said Letters Patent is hereby corrected as shown below:

Column 6, line 66, "1" should read --7--.

Column 7, line 25, "2" should read --10--;
line 37, "2" should read --10--.

Column 8, line 1, "2" should read --10--;
line 5, "2" should read --10--;
line 8, "2" should read --10--.

Signed and Sealed this

Twenty-fourth Day of September, 1996

*Attest:*

Bruce Lehman

BRUCE LEHMAN

*Attesting Officer*

*Commissioner of Patents and Trademarks*